US005707460A

United States Patent [19]

Chaterjee

[11] Patent Number: 5,707,460

[45] Date of Patent: Jan. 13, 1998

[54] METHOD OF PRODUCING PARTS HAVING IMPROVED WEAR, FATIGUE AND CORROSION RESISTANCE FROM MEDIUM ALLOY, LOW CARBON STEEL AND PARTS OBTAINED THEREFROM

[75] Inventor: Bimal K. Chaterjee, Jackson, Tenn.

[73] Assignee: Porter-Cable Corporation, Jackson, Tenn.

[21] Appl. No.: 500,533

[22] Filed: Jul. 11, 1995

[51] Int. Cl.[6] ..... C23C 8/32; C23C 8/56; C23C 8/76

[52] U.S. Cl. ..... 148/218; 148/219; 148/225; 148/226

[58] Field of Search ..... 148/218, 219, 148/225, 226

[56] References Cited

U.S. PATENT DOCUMENTS

| | | | |
|---|---|---|---|
| 3,854,363 | 12/1974 | Merkell et al. | 83/834 |
| 4,492,604 | 1/1985 | Muller et al. | 148/15.5 |
| 4,596,611 | 6/1986 | Dawes et al. | 148/16.5 |
| 5,211,768 | 5/1993 | Presisser et al. | 148/230 |
| 5,297,909 | 3/1994 | Tsay et al. | 411/29 |
| 5,389,161 | 2/1995 | Wawra et al. | 148/242 |

FOREIGN PATENT DOCUMENTS

| | | | |
|---|---|---|---|
| 0536986 | 4/1993 | European Pat. Off. | 148/218 |
| 54-17699 | 7/1979 | Japan | 148/219 |
| 56-72169 | 6/1981 | Japan | 148/219 |

OTHER PUBLICATIONS

"Salt Bath Nitridling Growing in Japan, Europe", Harry E. Chandler, *Metals International* (reprint)from Aug. 1986 issue of Metal Progress magazine).

"Investigation of Surface Layer and Wear Behavior of Nitrided Gear Drives", Claus Razim, *Gear Technology*, Mar./Apr. 1994, pp. 18–24.

"Basics of Salt Bath Nitriding", Mr. James r. Easterday, P.E., *Proceedings from Salt Bath Nitriding Seminar*, Oct. 29, 1985.

"The More Properties You Need—The More You Need Melonite®", Kolene Corporation, Copyright 1989 (Advertisement).

"Melonite®", Kolene Corporation, pp. 1–20 no date.

*Primary Examiner*—Deborah Yee

*Attorney, Agent, or Firm*—Merchant, Gould, Smith, Edell, Welter & Schmidt, P.A.

[57] ABSTRACT

Improved corrosion, wear and fatigue resistance is provided for pieces formed of medium alloy, low carbon steel by subjecting the piece to a treatment process which includes a step of carburizing, followed by nitriding. The process is especially useful for producing durable and low-cost steel parts, for example for certain automotive and marine applications, pumps (especially positive displacement pumps), chemical or food processing equipment, power tools, and the like. The blade-carrying reciprocating shaft for a reciprocating power saw is a specific example.

14 Claims, No Drawings

METHOD OF PRODUCING PARTS HAVING IMPROVED WEAR, FATIGUE AND CORROSION RESISTANCE FROM MEDIUM ALLOY, LOW CARBON STEEL AND PARTS OBTAINED THEREFROM

BACKGROUND OF THE INVENTION

The present invention is directed to a process for treating pieces of medium alloy, low carbon steel to provide the pieces with excellent wear, fatigue and corrosion resistance. The medium alloy, low carbon steel permits the ready machining of pieces and the joining of two or more components by laser welding. In the process of the present invention, the piece is subjected to carburizing, followed by nitriding, to produce a final piece which has corrosion, wear and fatigue resistance which meets or exceeds that of stainless steel.

Stainless steel is, of course, well-known for its properties of excellent resistance to corrosion, wear and fatigue. However, there are many fields in which the use of stainless steel would be prohibitively expensive, despite its excellent properties. In addition, stainless steel is notoriously difficult to process, particularly to machine. This further limits the utility of stainless steel in certain fields.

There are a number of fields in which the excellent corrosion, fatigue and wear resistance of stainless steel is desirable but the use of stainless steel is impractical. These include certain automotive and marine applications, pumps (especially positive displacement pumps), chemical or food processing equipment, power tools, and the like. Taking the field of power tools as an example, and more specifically, in the case of a reciprocating power saw, the cutting blade is generally carried by a reciprocating shaft, which is driven in a back and forth motion by a reciprocating drive member. The speed of the reciprocation, the forces and heat generated by the cutting action, the acidic nature of the wood being cut, the sawdust and other debris associated with the cutting, etc., result in a very harsh operating environment for the parts of the power saw, such as the reciprocating shaft, in terms of corrosion, fatigue and wear, especially for keyless versions. It would be desirable to provide a reciprocating shaft (and similar parts) which has corrosion, fatigue and wear resistance at least equivalent to that of stainless steel. However, stainless steel itself is too expensive to be used practically and competitively as a material for reciprocating shafts in power tools. The use of stainless steel is rendered even more impractical for this purpose by the difficulties in machining stainless steel, since parts such as reciprocating shafts are machined to very close tolerances, especially in high quality power tools. Of course, this problem is equally applicable to numerous other fields, such as those mentioned above.

In addition, recently it has been found that certain steel parts, which have typically been of one piece design, can be improved by fabricating the part from two or more components which are joined together, e.g. by welding. See, for example, the two-piece welded reciprocating power saw shaft of co-pending application Ser. No. 08/495,825 filed Jun. 28, 1995 (Attorney Docket 5809.132US01), the disclosure of which is incorporated herein by reference, in which the shaft is formed by welding together two component pieces. This permits the shaft pieces to be configured so as to reduce the mass of the shaft and increase the height of a drive surface on the shaft, allowing the shaft to maintain better contact with the reciprocating driver throughout the full range of reciprocating motion. However, the requirement of welding imposes further limitations on the material of the shaft, since not all steels are suitable for welding processes, especially for the desirable laser or electron beam welding processes. For example, while a leaded steel provides desirable properties in terms of machining, it is not good for welding.

Medium alloy, low carbon steels, such as 8620 steel enjoy a number of potentially useful properties in terms of machinability and weldability. Unfortunately these materials generally do not have excellent corrosion, wear and fatigue resistance and pieces intended for rigorous uses (such as reciprocating shafts for power saws discussed previously) made of these materials exhibit an undesirably short lifetime. Even carburized medium alloy, low carbon steels show undesirably low corrosion resistance for use in such fields.

SUMMARY OF THE INVENTION

It is the object of the present invention to provide a steel which is well-suited for processing steps such as machining and welding, especially laser or electron beam welding, but which enjoys excellent corrosion, wear and fatigue resistance.

It is a further object to provide a material suitable for use in the production of pieces which are formed by welding two or more component parts together, especially by laser welding.

It is a still further object of this invention to provide a medium alloy, low carbon steel material which can be used to form a two-part welded reciprocating shaft for a power saw, which has corrosion, wear and fatigue resistance at least comparable to that of stainless steel.

The above objects and others are provided by treating a medium alloy, low carbon steel piece by a process which includes steps of first carburizing the piece and then nitriding the carburized piece. Since the piece is made of medium alloy, low carbon steel, it can be readily machined, welded, etc. prior to the treatment process. The treatment process results in a piece which has corrosion, fatigue and wear resistance which is at least comparable to that of stainless steel.

DETAILED DESCRIPTION OF THE INVENTION

The present invention is directed to a process for improving the corrosion, wear and fatigue resistance of medium alloy, low carbon steel pieces, and to the pieces obtained from that treatment process. Medium alloy, low carbon steels are known in the art. Referring to the SAE numbering system for compositions of standard steels, medium alloy steels generally are those whose first two digits are 61 or higher. Non-leaded steels are preferred, particularly for pieces which are to be subjected to welding. Again referring to the SAE numbering system, the last two digits of the identifying number for low carbon steels are 32 or less (generally indicating a carbon content no more than about 0.30–0.35% by weight). Thus, examples of medium alloy, low carbon steels include those having SAE identifying numbers of 6118, 6120, 8115, 8615, 8617, 8620, 8622, 8625, 8627, 8630, 8720, 8822, 9310, 94B15, 94B17, and 94B30. Of these, the 8620 steel is especially preferred for reciprocating shafts for power saws. The medium alloy, low carbon steels show good strength properties and are well-suited for welding, including laser welding, and are readily machined.

Thus, in the present invention, a medium alloy, low carbon steel piece is fabricated by any suitable process, including the joining of two or more component parts e.g. by welding, and then machined if necessary. The piece is then subjected to a two-step thermal treatment. In the first step, the piece is carburized. That is, the piece is treated so as to cause carbon to be absorbed and diffused into the surface of the piece. The carburizing provides improved fatigue and wear resistance to the piece. In the case of a welded piece, the carburizing also may normalize the weld microstructure.

Any known carburizing process can be applied in the present invention. For example, gas carburizing with hydrocarbons such as methane and/or propane at temperatures around 900° C. is useful. Those skilled in the art will recognize that treatment time and temperature can be varied to effect different carburizing results. Carburizing conditions which are presently used for case hardening medium alloy, low carbon steels such as 8620 steel are suitable for the present invention. After carburizing, the piece can be subjected to any necessary finish grinding and polishing steps which are required. In the case of the reciprocating shaft for a power saw, carburizing to provide an effective case of about 0.013 to 0.018 inch and a tempered hardness of 45/48 RC was suitable. The 45/48 RC tempered hardness has been found to be useful for accommodating finish grinding operations.

After carburizing and any required finish grinding or polishing, the piece is subjected to nitriding. The nitriding step provides improved corrosion resistance. It has also been discovered that the nitriding of the carburized piece provides improved wear and fatigue resistance. As a result, the piece obtained in accordance with the present invention is a medium alloy, low carbon steel which exhibits corrosion, wear and fatigue resistance properties which are at least equivalent to those of stainless steel.

Any known nitriding process can be used for the present invention, including liquid nitriding, gas nitriding and plasma nitriding. Of these, liquid nitriding, particularly salt bath nitriding, is preferred in terms of economy.

One useful nitriding system is the MELONITE or MELONITE QPQ system available from Kolene Corporation of Detroit, Mich. (provided under license from Degussa of Frankfurt, Germany). The MELONITE systems nitride steel parts by treatment in a molten salt bath formed from cyanates and carbonates of potassium and sodium. The MELONITE systems are particularly desirable for environmental reasons, i.e. unlike previous systems such as the TUFFTRIDE system, no cyanide salts are used, and various quenching baths remove any cyanide which is formed during the nitriding process. Typically, the MELONITE process produces a compound layer about 0.0004–0.0008 inches deep, and a nitrogen diffusion layer to a depth of about 0.010–0,040 inches. As with carburizing, the nitriding effect is time and temperature dependent. To improve economy, treatment at relatively high temperatures for relatively short times is preferred. For example, it has been found that a nitriding temperature of 1050° F. for a cycle of two hours produces the desired nitriding effect for reciprocating shafts for power saws. In this case, a white compound layer of nitride was formed to a depth of about 0.0004 to 0.0008 inch, with a diffusion zone depth of about 0.010 to 0.020 inch. In addition, a higher tempering temperature may result in martensite being segregated into ferrite, and alloying of carbides to help formation of $Fe_3N$. The nitriding results in the formation of a uniform white nitride layer on the surface of the piece.

It is believed that the combination of carburizing followed by nitriding can promote formation of $Fe_3C$, which is nitrogen-bearing and thus, upon nitriding promotes the diffusion of nitrogen in the case. In addition, the carburizing may promote binding of chromium as carbide, which again promotes diffusion of nitrogen. Carburizing also assists in the development of a more uniform microstructural composition in the prescribed case depth. The more consistent microconstituents provide more predictable results from the nitriding process on a lot to lot basis. Neutral hardening might not produce uniform sub-surface metallurgical conditions, since it is difficult to maintain ideal furnace atmosphere conditions with sufficient accuracy to obtain highly reproducible neutral hardening of low carbon steel. This can cause significant fluctuation in the effect of the nitriding process.

While a detailed description of the present invention has been provided above, the present invention is not limited thereto, and modifications which do not depart from the spirit and scope of the present invention will be apparent to those skilled in the art. Instead, the invention is defined by the claims which follow.

What is claimed is:

1. A method of treating a piece formed of medium alloy, low carbon steel, comprising:

(a) subjecting the piece to a carburizing treatment whereby a martensitic case is formed at the surface of the piece; and (b) subsequently subjecting the piece to nitriding.

2. The method of claim 1, wherein the piece is formed by joining at least two components together by welding before carburizing.

3. The method of claim 2, further comprising machining the piece or the components prior to carburizing.

4. The method of claim 1, wherein the nitriding is salt bath nitriding.

5. The method of claim 4, wherein the salt bath nitriding is carried out with a bath of molten cyanate and carbonate salts of potassium and sodium.

6. The method of claim 2, wherein the welding is laser welding.

7. The method of claim 1, wherein the medium alloy, low carbon steel has a carbon content of not more than about 0.32%.

8. A piece formed of medium alloy, low carbon steel, produced by a method according to claim 1.

9. A piece formed of medium alloy, low carbon steel, having corrosion and wear resistance properties at least comparable to those of an otherwise identical piece formed from stainless steel.

10. The piece of claim 8, which is a component of a reciprocating saw.

11. The piece of claim 10, which is a reciprocating shaft for carrying a blade of a reciprocating saw.

12. The piece of claim 9, which is a component of a reciprocating saw.

13. The piece of claim 12, which is a reciprocating shaft for carrying a blade of a reciprocating saw.

14. The method of claim 1, wherein the steel is selected from the group consisting of 6118, 6120, 8115, 8615, 8617, 8620, 8622, 9625, 8627, 8630, 8720, 8822, 9310, 94B15, 94B17 and 94B30 steel.

* * * * *